US010836459B2

(12) United States Patent
Li et al.

(10) Patent No.: US 10,836,459 B2
(45) Date of Patent: Nov. 17, 2020

(54) SELF-PROPELLED INTEGRATED SHIP FOR TRANSPORTING AND INSTALLING IMMERSED TUBES OF UNDERWATER TUNNEL AND CONSTRUCTION PROCESS

(71) Applicant: CCCC FIRST HARBOR ENGINEERING CO., LTD., Tianjin (CN)

(72) Inventors: Yiyong Li, Tianjin (CN); Qiang Guo, Tianjin (CN); Zengjun Li, Tianjin (CN)

(73) Assignee: CCCC FIRST HARBOR ENGINEERING CO., LTD., Tianjin (CN)

( * ) Notice: Subject to any disclaimer, the term of this patent is extended or adjusted under 35 U.S.C. 154(b) by 0 days.

(21) Appl. No.: 16/412,343

(22) Filed: May 14, 2019

(65) Prior Publication Data

US 2019/0263483 A1 Aug. 29, 2019

Related U.S. Application Data

(63) Continuation-in-part of application No. PCT/CN2017/110395, filed on Nov. 10, 2017.

(30) Foreign Application Priority Data

Nov. 17, 2016 (CN) ..... 2016 1 1022374
May 5, 2019 (CN) ..... 2019 1 0368756

(51) Int. Cl.
*B63B 27/00* (2006.01)
*B63B 35/03* (2006.01)
(Continued)

(52) U.S. Cl.
CPC ..... *B63B 35/03* (2013.01); *B63B 27/08* (2013.01); *B63B 27/16* (2013.01); *B63B 35/003* (2013.01); *B63B 75/00* (2020.01)

(58) Field of Classification Search
CPC .. B63B 35/03; B83B 35/003; E02B 201/0047
See application file for complete search history.

(56) References Cited

U.S. PATENT DOCUMENTS 485,983 A * 11/1892 Powell ..... E02D 29/073 405/135
928,536 A * 7/1909 Pino ..... B63C 7/04 114/51
(Continued)

FOREIGN PATENT DOCUMENTS

CH 598 988 5/1978
CN 2615042 Y 5/2004
(Continued)

OTHER PUBLICATIONS

The extended European Search Report of corresponding European application No. 17872525.5-1015 / 3524506, dated Sep. 24, 2019.
(Continued)

*Primary Examiner* — Benjamin F Fiorello
(74) *Attorney, Agent, or Firm* — J.C. Patents

(57) ABSTRACT

A self-propelled integrated ship for transporting and installing immersed tubes of an underwater tunnel comprises a first ship body and a second ship body which are parallel with each other, a connection structure is arranged between the first ship body and the second ship body; the first ship body, the second ship body and the connection structure are provided with hauling and hoisting devices, a loading space is formed between the first ship body and the second ship body and below the connection structure; a to-be-installed member is arranged in the loading space and is connected with the ship; and the first ship body and the second ship body are provided with propelling power devices and positioning devices. The loading space is provided in a lower part of the integrated ship, and a member to be transported is placed in the loading space and floated in the water, so that
(Continued)

most of the weight of the member is shared by buoyancy. The member is transported to a designated site and installed precisely. Thus, the independent transportation and installation of immersed tubes of the underwater tunnel or similar large members with various sizes can be successfully realized by one self-propelled ship without assistance of other additional ships. Moreover, there is no need to close navigation lanes to other ships, thus not affecting the navigations of the other ships.

18 Claims, 6 Drawing Sheets

(51) Int. Cl.

| | |
|---|---|
| ***B63B 27/16*** | (2006.01) |
| ***B63B 27/08*** | (2006.01) |
| ***B63B 35/00*** | (2020.01) |
| *B63B 75/00* | (2020.01) |

(56) References Cited

U.S. PATENT DOCUMENTS

| | | | | |
|---|---|---|---|---|
| 1,060,271 | A * | 4/1913 | McBean et al. | E02D 29/067 405/136 |
| 3,807,336 | A | 4/1974 | Briggs | |
| 3,901,038 | A * | 8/1975 | Olsen | E02D 29/073 405/135 |
| 4,604,940 | A * | 8/1986 | Mendelsohn | C08G 18/12 528/65 |
| 4,848,967 | A * | 7/1989 | Weyler | E02B 17/024 405/204 |
| 5,542,783 | A * | 8/1996 | Pollack | B63B 21/502 166/352 |
| 5,553,977 | A * | 9/1996 | Andersen | B63B 35/003 405/204 |
| 5,662,434 | A * | 9/1997 | Khachaturian | B63B 9/065 405/204 |
| 5,800,093 | A * | 9/1998 | Khachaturian | B63B 9/065 114/51 |
| 5,829,919 | A * | 11/1998 | Heerema | B63B 35/003 405/209 |
| 5,899,635 | A * | 5/1999 | Kuja | E02D 29/067 405/134 |
| 6,149,350 | A * | 11/2000 | Khachaturian | B63B 9/065 114/51 |
| 6,318,931 | B1 * | 11/2001 | Khachaturian | B63B 9/065 405/204 |
| 6,347,909 | B1 * | 2/2002 | Kocaman | E02B 17/00 114/259 |
| 6,367,399 | B1 * | 4/2002 | Khachaturian | B63B 9/065 114/61.1 |
| 6,676,334 | B2 | 1/2004 | Horton, III | |
| 8,312,828 | B2 * | 11/2012 | Luo | B63B 9/065 114/121 |
| 8,708,604 | B2 * | 4/2014 | Luo | E02B 17/00 405/196 |
| 8,960,114 | B2 * | 2/2015 | Khachaturian | B63C 7/20 114/51 |
| 8,985,040 | B2 * | 3/2015 | Khachaturian | B63C 7/16 114/51 |
| 9,003,988 | B2 * | 4/2015 | Khachaturian | B63C 7/04 114/51 |
| 10,220,916 | B2 * | 3/2019 | Hooper | B63B 1/121 |
| 10,279,872 | B2 * | 5/2019 | Khachaturian | B63B 35/44 |
| 2003/0103812 | A1 * | 6/2003 | Linden | B63B 9/065 405/203 |
| 2003/0108392 | A1 * | 6/2003 | McCarthy | B63B 9/065 405/196 |
| 2003/0192465 | A1 * | 10/2003 | Roodenburg | B63B 1/12 114/330 |
| 2004/0218983 | A1 * | 11/2004 | Roraas | E02B 17/00 405/204 |
| 2009/0003936 | A1 * | 1/2009 | Finn | E02B 17/04 405/202 |
| 2010/0316449 | A1 * | 12/2010 | Ayers | B63B 9/065 405/205 |
| 2011/0305522 | A1 * | 12/2011 | Haney | B63B 21/00 405/204 |
| 2012/0000407 | A1 * | 1/2012 | Ytournel | B63B 35/003 114/26 |
| 2012/0110819 | A1 * | 5/2012 | Perol | B63B 9/065 29/428 |
| 2013/0045056 | A1 * | 2/2013 | Meeuws | B63B 35/003 405/195.1 |
| 2014/0352592 | A1 * | 12/2014 | Dunne | F03B 13/264 114/72 |
| 2015/0240439 | A1 * | 8/2015 | Lee | E02B 17/021 405/195.1 |

FOREIGN PATENT DOCUMENTS

| | | | | |
|---|---|---|---|---|
| CN | 2701748 | Y | 5/2005 | |
| CN | 202169997 | U | 3/2012 | |
| CN | 102530189 | A | 7/2012 | |
| CN | 102642601 | | 8/2012 | |
| CN | 102642601 | A | 8/2012 | |
| CN | 103912013 | A | 7/2014 | |
| CN | 104652480 | A | 5/2015 | |
| CN | 205475326 | U | 8/2016 | |
| CN | 106516021 | A | 3/2017 | |
| CN | 206187298 | U | 5/2017 | |
| KR | 10-1262806 | B1 | 5/2013 | |
| KR | 10-2014-0051531 | | 5/2014 | |
| WO | WO-03066427 | A1 * | 8/2003 | B63B 1/107 |

OTHER PUBLICATIONS

The International Search Report of corresponding international PCT application No. PCT/CN2017/110395, dated Jan. 29, 2018.
The Chinese Search Report of corresponding Chinese application No. 201611022374.9, dated Oct. 21, 2017.

* cited by examiner

SELF-PROPELLED INTEGRATED SHIP FOR TRANSPORTING AND INSTALLING IMMERSED TUBES OF UNDERWATER TUNNEL AND CONSTRUCTION PROCESS

CROSS-REFERENCE TO RELATED APPLICATIONS

The present application is a continuation-in-part application of International Application No. PCT/CN2017/110395 filed on Nov. 10, 2017 and claims priority to Chinese Patent Application No. 201910368756.4 filed on May 5, 2019, and this international application claims priority to Chinese Patent Application No. 201611022374.9 filed on Nov. 17, 2016, the disclosures of the aforementioned applications are hereby incorporated by reference in their entireties.

TECHNICAL FIELD

The present application relates to the technical field of cross-river and cross-ocean tunnel construction engineering, and in particular to a self-propelled integrated ship for transporting and installing immersed tubes of an underwater tunnel and a construction process.

BACKGROUND OF THE PRESENT INVENTION

The immersed tunnel is an underwater structure constructed under water for allowing person and vehicles to pass through in order to solve the transportation between straits, bays or rivers. Generally, the immersed tunnel is prefabricated segmentally and then transported in water to a designated site for construction and installation. In order to ensure the smooth passage of vehicles inside the immersed tubes after the tunnel has been constructed, the immersed tube is very huge in size. Usually, the weight of each immersed tube exceeds 10,000 tons. The transportation and installation of such a huge object has become a very important aspect that restricts the construction efficiency and construction period of the underwater tunnel project.

The traditional transportation method is realized by sealing two ends of the immersed tube first, reserving a plurality of hauling and hoisting points at the top of the immersed tube, and then equipping with a plurality of high-power towing ships to haul the immersed tube for water transportation; or straddling sinking barges used for installation of the immersed tube over the immersed tube and connecting the sinking barges to the immersed tube. However, since both the immersed tube and the sinking barge do not have sailing power, the immersed tube needs to be hauled by a plurality of high-power towing ships, and the immersed tube carries the sinking barge as a whole to be transported to the site where the immersed tube is to be installed. In the traditional transportation method, the transportation speed is slow, and the cooperation between the towing ships is difficult so that it is easy to yaw. Moreover, during the transportation, the navigation lane needs to be closed, and other ships are prohibited from passing, which seriously affects the shipping traffic. Also, the traditional installation method needs to build dedicated sinking barges and configuring two sinking barges to realize precisely location and installation. When the traditional installation method is adopted, the organizing of the marine activities is complicated and difficult, the construction period is long, the working efficiency is low, the security risk is high, and construction cost is high.

SUMMARY OF THE PRESENT INVENTION

In view of the problems existing in the transportation and installation process of the immersed tubes of cross-river and cross-ocean tunnels, the present application provides a self-propelled integrated ship for transporting and installing immersed tubes of an underwater tunnel and a construction process.

An aspect of the present application provides a self-propelled integrated ship for transporting and installing immersed tubes of underwater tunnel, wherein comprises a first ship body, a second ship body, a connection structure, hauling and hoisting devices, propelling power devices and positioning devices; the first ship body and the second ship body are parallel with each other, the connection structure is arranged between the first ship body and the second ship body, the first ship body, the second ship body and the connection structure are provided with the hauling and hoisting devices; a loading space is formed between the first ship body and the second ship body and below the connection structure, a to-be-installed member is arranged in the loading space and is connected with the ship; and the first ship body and the second ship body are provided with the propelling power devices and the positioning devices.

Preferably, the loading space is opened downward, and the to-be-installed member is an immersed tube which is floated in water during transportation.

Preferably, protruding members are arranged on a bottom of the connection structure, and a number of the protruding members is greater than or equal to 2; when the integrated ship is in a water ballasting state, a pressure contact is formed between bottom surfaces of the protruding members and the immersed tube subjected to buoyancy so as to transmit a propelling power of the integrated ship to the immersed tube and drive the immersed tube to sail together.

Preferably, the propelling power devices comprise a main propeller respectively arranged at a stern of the first ship body and a stern of the second ship body, and lateral propellers respectively arranged at a bow and the stern of the first ship body and a bow and the stern of the second ship body.

Preferably, a dynamic positioning system is further provided on the integrated ship to control powers of the propelling power devices so as to successfully realize tracks tracking function and a dynamic positioning function.

Another aspect of the present application provides a construction process of transporting and installing immersed tubes of an underwater tunnel, which is realized by the integrated ship; the construction process comprises the following steps:

outfitting, comprising:

moving the integrated ship to above a immersed tube by winches, or moving a immersed tube to below the integrated ship by winches on the integrated ship;

outfitting a sinking and positioning system:

a first winch, a second winch, a third winch, a fourth winch, a fifth winch and a sixth winch all used for sinking and positioning the immersed tube are provided on the integrated ship; a first cable guiding device is provided at the bow of the first ship body, and connecting a hoisting cable of the first winch to a position on a top surface of the immersed tube near the second ship body along a transverse direction of the immersed tube via the first cable guiding device; a second cable guiding device is provided at the bow of the second ship body, and connecting a hoisting cable of the second winch to a position on the top surface of the immersed tube near the first ship body along the transverse direction of the immersed tube via the second cable guiding device; a third cable guiding device is provided at the stern of the first ship body, and connecting a hoisting cable of the third winch to a position on the top surface of the immersed tube near the second ship body along the transverse direction of the immersed tube via the third cable guiding device; a fourth cable guiding device is provided at the stern of the second ship body, and connecting a hoisting cable of the fourth winch to a position on the top surface of the immersed tube near the first ship body along the transverse direction of the immersed tube via the fourth cable guiding device; and the first to fourth winches are used for adjusting the transverse position of the immersed tube; and a connection structure above a front end of the immersed tube is a first connection structure, and a connection structure above a rear end of the immersed tube is a second connection structure; the first connection structure is provided with a fifth cable guiding device, and connecting a hoisting cable of the fifth winch to a position at a rear end of the top surface of the immersed tube along an axis of the immersed tube via the fifth cable guiding device; the second connection structure is provided with a sixth cable guiding device, and connecting a hoisting cable of the sixth winch to a position at a front end of the top surface of the immersed tube along the axis of the immersed tube via the sixth cable guiding device; and the fifth winch and the sixth winch are used for adjusting the longitudinal position of the immersed tube;

connecting the integrated ship with the immersed tube, comprising:

adding ballast water to the integrated ship to make the integrated ship move downward, and protruding members on the integrated ship contacts the top surface of the immersed tube; adding ballast water continuously to generate a pressure between the integrated ship and the immersed tube and the pressure is not less than 200 tons;

tightening hoisting cables between the integrated ship and the immersed tube by hoisting winches provided on the integrated ship and used for lifting up, lifting down and adjusting the immersed tube;

floating transportation of the immersed tube: using the main propellers and the lateral propellers to drive the integrated ship for self-propulsion, and the integrated ship drives the immersed tube to move and steer along with the integrated ship by interaction force generated by the connection between the integrated ship and the immersed tube; resisting external loads received by the integrated ship and the immersed tube during the floating transportation by means of power generated by the main propellers and the lateral propellers; utilizing a dynamic positioning system provided on the integrated ship to ensure that the integrated ship and the immersed tube are navigated along a planned route and positioned to a site where the immersed tube is to be installed;

installing the immersed tube, comprising:

positioning and mooring the integrated ship by the dynamic positioning system;

discharging the ballast water from the integrated ship to release the pressure between the protruding members and the immersed tube;

the immersed tube begins to be lifted down by the hoisting cables, and controlling the first winch to the sixth winch to rectify the transverse and longitudinal positions of the immersed tube and adjust gradient of the immersed tube, so that the installation of the immersed tube is further completed.

Compared with the prior art, the present application has the following beneficial effects.

1. The present application changes the traditional method in which additional towing ships are required to haul the immersed tube for transportation, breaks the traditional idea of placing cargo on the ship for transportation (such as the ship disclosed in Patent Application Publication No. CN102642601B, which cannot transport large members such as immersed tubes), and provides a novel integrated ship for immersed tubes or similar large members. A loading space is provided in a lower part of the integrated ship, and a member to be transported is placed in the loading space and floated in the water. The weight of the member is shared by buoyancy, and the member is transported to a designated site. Thus, the independent transportation of immersed tubes of the underwater tunnel or similar large members with various sizes can be successfully realized by one self-propelled ship without being hauled by other additional ships. Moreover, there is no need to close navigation lanes to other ships during the transportation in the public navigation lane, thus not affecting the navigations of the other ships.

2. In the integrated ship provided by the present application, by reasonably arranging installation devices on the ship, precise installation can be realized without assistance of other ships, the integration of transportation and installation is successfully realized, and the installation operation is realized without dedicated sinking barges.

3. The integrated ship provided by the present application has a loading sailing speed of 5 to 6 knots and an unloading sailing speed of more than 10 knots, and has the ability to resist against 2-knot transverse flow, and realizes long-distance transportation. The ship is equipped with a dynamic positioning system so as to have a tracks tracking function, and is small in radius of gyration and small in occupation of navigable water. Moreover, there is no need to close public navigation lanes during the floating transportation, and the amount of dredging for dedicated floating transportation lane is small and ship has emergency support capability for rapid return under abnormal conditions.

4. The catamaran type ship in the present application has a higher stability, and anti-sinking and anti-capsizing capabilities.

5. In the construction process of immersed tubes of an underwater tunnel provided by the present application, the transportation and installation processes of the immersed tube are completed by the integrated ship, so the consistency of the operation is good, the installation precision is high, and the construction period and cost of the engineering can be obviously reduced, resulting in great economic benefits.

wherein:

1: first ship body; 2: second ship body; 3: connection structure; 31: first connection structure; 32: second connection structure; 4: winch; 401: first winch; 402: second winch; 403: third winch; 404: fourth winch; 405: fifth winch; 406: sixth winch; 407: seventh winch; 408: eighth winch; 409: ninth winch; 410: tenth winch; 5: crane; 6: propelling power device; 61: main propeller; 62: lateral propeller; 7: positioning device; 8: immersed tube; 91: protruding member; 92: groove; 93: pull cable; 94: spacer; 95: bolt; 96: wedge; 101: first cable guiding device; 102: second cable guiding device; 103: third cable guiding device; 104: fourth cable guiding device; 105: fifth cable guiding device; 106: sixth cable guiding device; 107: seventh cable guiding device; 108: eighth cable guiding device; 109: ninth cable guiding device; 110: tenth cable guiding device; and, 20: dynamic positioning system.

DETAILED DESCRIPTION OF THE PRESENT INVENTION

The present application will be specifically described below with reference to the exemplary implementations. However, it should be understood that elements, structures and features in one implementation can also be advantageously incorporated into other implementations, unless otherwise further stated.

In the descriptions of the present application, it is to be noted that: (1) the orientation or positional relationship indicated by the term "inner", "outer", "upper", "lower", "front", "rear" or the like is based on the positional relationship shown by the accompanying drawings, is merely used for conveniently description of the present application and simplifying the description and not intended to indicate or imply that the indicated device or element must have a particular orientation or be constructed and operated in a particular orientation, and therefore cannot be interpreted as limitations to the present application; (2) the term "first", "second" or the like is merely for descriptive purpose and cannot be interpreted as indicating or implying the relative importance; and, (3) the immersed tube itself does not distinguish front end and rear end, but in the present application, for convenience of description, an end close to the bow of the integrated ship is defined as a front end of the immersed tube and an end close to the stern of the integrated ship is defined as a rear end of the immersed tube.

Figure 1:
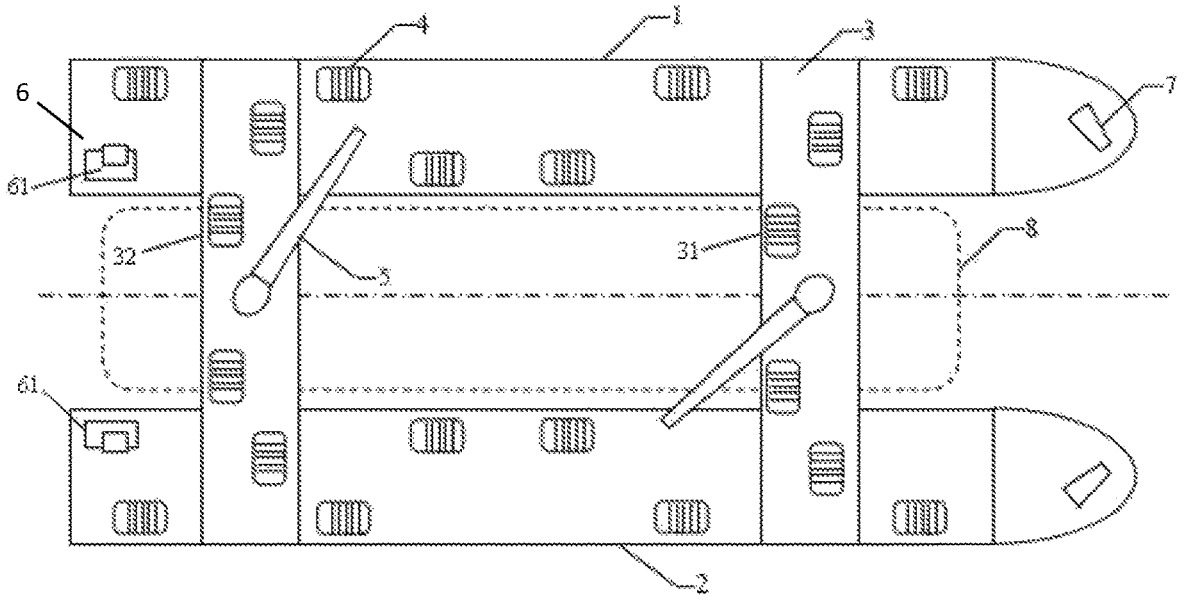
FIG. 1 is a schematic structural diagram of a top view of an integrated ship according to an embodiment of the present application.
Figure 2:
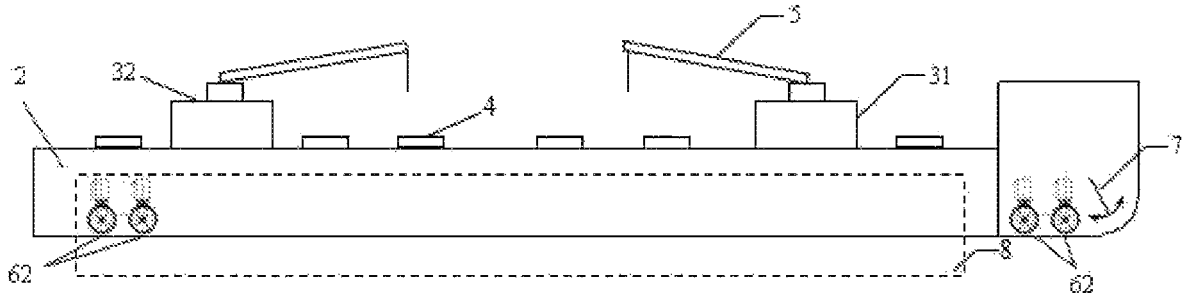
FIG. 2 is a schematic structural diagram of a side view of the integrated ship according to an embodiment of the present application.

As shown in FIGS. 1 and 2, an embodiment of the present application provides a self-propelled integrated ship for transporting and installing immersed tubes of an underwater tunnel, comprising a first ship body 1 and a second ship body 2 which are parallel with each other, a connection structure 3 for connecting the first ship body 1 and the second ship body 2 is arranged between the first ship body 1 and the second ship body 2, a loading space for accommodating a to-be-installed member is formed between the first ship body 1 and the second ship body 2 and below the connection structure 3; the first ship body 1, the second ship body 2 and the connection structure 3 are provided with hauling and hoisting devices, and the to-be-installed member is connected with the ship through the hauling and hoisting devices; the first ship body 1 and the second ship body 2 are provided with propelling power devices 6 and positioning devices 7, respectively.

The to-be-installed member is suspended in the loading space by the hauling and hoisting devices and floated in water. The to-be-installed member is float-transported to a designated site by the propelling power devices 6 arranged on the ship bodies. At this time, the hauling and hoisting devices stably sink the to-be-installed member to an underwater installation site to perform installing process. Specifically, in the present application, the to-be-installed member is an immersed tube 8; however, it should be understood that the to-be-installed member may also be other large underwater members to be installed.

In this way, the integrated ship provided by the present application has transportation and installation functions of a large member at the same time and successfully realizes the integration of transportation and installation of the large member. During the transportation, the traditional method in which the immersed tube is directly hauled by a plurality of towing ships and the sinking barges are carried by the immersed tube to move to the installation site is changed. Rather, a self-propelled integrated ship suitable for large members such as immersed tubes is designed. By placing the member to be transported below the connection structure and floating the member to be transported in the water, the buoyancy is tactfully utilized to float-transport the member to the installation site, and there is no need for hauling and transporting in different directions by a plurality of towing ships, thus avoiding additional power consumption, accidental yaw and the like. Since the integrated ship occupies a small sea area, the normal navigation of other ships will not be affected, and there is no need to close to the navigation lane. In addition, the integrated ship itself has the installation function, it is unnecessary to additionally dispatch sinking barges, so the construction process is simplified, the construction period is shortened, the working efficiency is improved, and the cost is reduced.

Since the immersed tube 8 is arranged below, but not above, the connection structure 3 in the embodiment of the present application, there is no requirement for the extended area of the connection structure 3.

The loading space is opened downward to realize the floating transportation of the to-be-installed member. In this embodiment of the present application, the to-be-installed member is an immersed tube 8 which is floated in water during transportation.

Further, to realize the transportation of to-be-installed members of different sizes, the loading space between the first ship body 1 and the second ship body 2 and below the connection structure 3 is a through space.

As an optional implementation, the connection between the immersed tube 8 and the integrated ship is rigid connection, so that the immersed tube 8 and the integrated ship are float-transported as a whole. Here, the rigid connection refers to a connection mode in which the degree of freedom is constrained in six directions. However, it should be understood that the connection between the immersed tube 8 and the integrated ship may also be flexible connection, for example, using a steel wire rope or the like to realize the connection.

Figure 3:
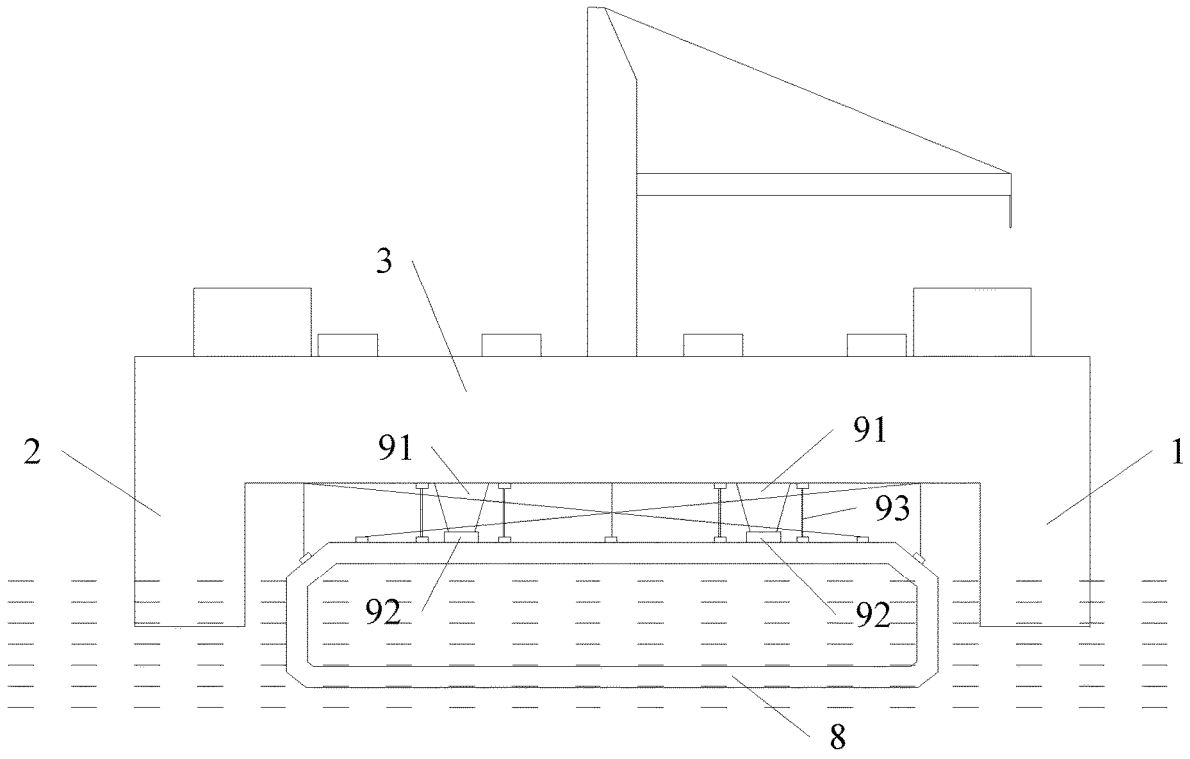
FIG. 3 is a schematic diagram of a connection mode of the integrated ship and an immersed tube according to an embodiment of the present application.

As shown in FIG. 3, protruding members 91 are arranged on a bottom of the connection structure 3, and a number of the protruding members 91 is greater than or equal to 2; when the integrated ship is in a water ballasting state, a pressure contact is formed between bottom surfaces of the protruding members 91 and the immersed tube 8 subjected to buoyancy so as to transmit a propelling power of the integrated ship to the immersed tube 8 and drive the immersed tube 8 to sail together. By providing two or more protruding members 91 to resist against the immersed tube 8, the balance of the immersed tube 8 can be realized, and the deflection of the immersed tube 8 is avoided during the floating transportation.

Figure 4:
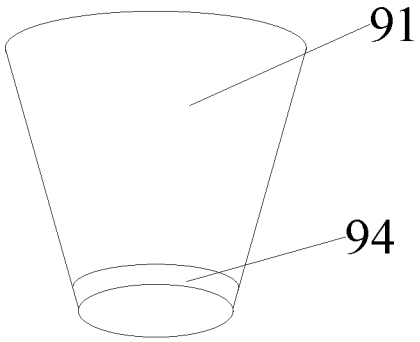
FIG. 4 is a schematic diagram of a protruding member with a spacer according to an embodiment of the present application.

As a preferred implementation, as shown in FIG. 4, a spacer 94 is provided on the bottom surface of each of the protruding members 91, and a friction coefficient between the spacer 94 and the immersed tube 8 is greater than or equal to 0.5, so that sufficient friction can be provided between the integrated ship and the immersed tube 8 to drive the floating transportation of the immersed tube 8. The spacer 94 may be a rubber spacer or made of other materials satisfying the requirements for the friction coefficient. It is to be noted that the protruding members 91 shown in FIG. 4 each have a circular cross section, but the shapes of the protruding members 91 are not specifically required in the present application. For example, the cross sections of the protruding members 91 may also be square or in other shapes.

As a preferred implementation, as shown in FIG. 3, the protruding members 91 are inserted into grooves 92 formed correspondingly on a top surface of the immersed tube 8 to limit movement of the immersed tube 8 relative to the integrated ship.

Figure 5:
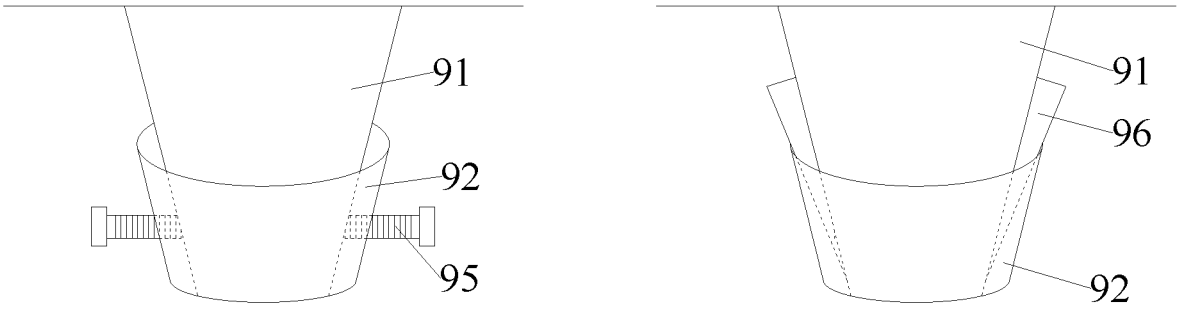
FIG. 5 is a schematic diagram of a limiting mode according to an embodiment of the present application.

Further, a limiting device is arranged between the groove 92 and the protruding member 91 to realize the firm connection of the groove 92 and the protruding member 91. In this embodiment, the limiting device may be implemented in various ways. As shown in FIG. 5, when the limiting device is a bolt 95, the bolt may be screwed into the groove 92 from a side face of the groove 92 and resisted against the protruding member 91 to limit the movement of the protruding member 91. When the liming device is a wedge 96, the wedge 96 may be embedded into a clearance between the protruding member 91 and the groove 92 to limit the movement of the protruding member 91. The bolt 95 and the wedge 96 in this embodiment are merely illustrative, and it is also possible to use any other ways to realize the firm connection of the groove 92 and the protruding member 91.

To further limit the movement of the immersed tube, as shown in FIG. 3, a plurality of pull cables 93 connected to the immersed tube 8 are provided on the bottom of the connection structure 3 close to the protruding members 91. The pull ropes 93 may be made of a rigid material such as steel tube to enhance the limiting effect.

To enable the protruding members 91 to bear the pressure between the integrated ship and the immersed tube 8, preferably, bearing capacity of each of the protruding members 91 is greater than or equal to 10 tons.

An embodiment of the present application further provides an arrangement mode of the propelling power devices.

As shown in FIGS. 1 and 2, the propelling power devices 6 comprise a main propeller 61 respectively arranged at a stern of the first ship body 1 and a stern of the second ship body 2, and lateral propellers 62 respectively arranged at a bow and the stern of the first ship body 1 and a bow and the stern of the second ship body 2. The main propellers 61 are used for providing power to propel the integrated ship forward so as to ensure the traveling speed of the integrated ship. The lateral propellers 62 are used for providing power in a direction perpendicular to the sailing direction, so as to resist against the transverse flow and realize the in-situ steering of the integrated ship.

During the design process of the integrated ship of the present application, not only the resistance generated by the draught of the integrated ship itself but also the resistance suffered by the immersed tube during the floating transportation are taken into consideration to optimize the power of the propelling power devices 6. Preferably, the power of the lateral propellers 62 is greater than or equal to 500 kW.

As a preferred implementation, a number of the lateral propellers 62 arranged on the first ship body 1 is equal to a number of the lateral propellers 62 arranged on the second ship body 2.

Further, two lateral propellers 62 are respectively arranged at the bow and the stern of the first ship body 1, and two lateral propellers 62 are respectively arranged at the bow and the stern of the second ship body 2. Since the immersed tube 8 is arranged between the first ship body 1 and the second ship body 2, jet flows of the lateral propellers 62 will be blocked. In a case of providing the same lateral propelling force, when one lateral propeller 62 is provided, the required jet flow is larger; however, if the jet flow is larger, the loss of jet flow due to the action of the immersed tube 8 is larger, which is disadvantageous to the function of the lateral propeller 62. When two lateral propellers 62 are provided to act together, the distributed jet flows are reduced, and the loss of jet flows is smaller, so that the lateral propellers 62 can work effectively.

As a preferred implementation, a dynamic positioning system 20 (a DP system for short) is further provided on the integrated ship to control the powers of the propelling power devices 6 so as to successfully realize tracks tracking function and a dynamic positioning function. The DP system can control corresponding propelling power devices 6 to adjust corresponding power according to the desired motion mode of the integrated ship, so as to realize the desired motion.

Figure 6:
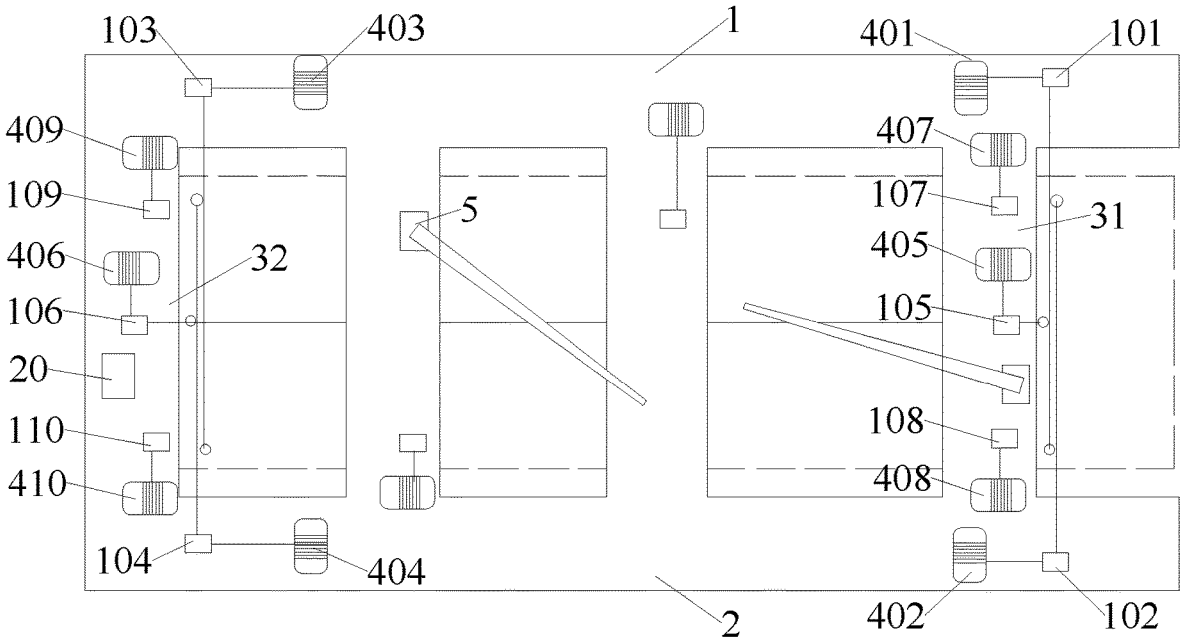
FIG. 6 is a top view of an arrangement mode of winches according to an embodiment of the present application.

As a preferred implementation, as shown in FIGS. 1 and 6, a number of the connection structures 3 is greater than or equal to 2, and the transportation and installation of immersed tubes 8 of different sizes is realized by combination of at least two connection structures 3; a connection structure 3 above a front end of the immersed tube 8 is a first connection structure 31, and a connection structure 3 above a rear end of the immersed tube 8 is a second connection structure 32.

As a preferred implementation, the hauling and hoisting devices comprise winches 4 and cranes 5. The winches 4 comprise more than four winches having a loading capacity greater than or equal to 2 tons.

As a preferred implementation, hoisting cables used for adjusting transverse and longitudinal positions of the immersed tube 8 are arranged in a crossed manner between the integrated ship and the immersed tube 8.

Specifically, as shown in FIG. 6, the hauling and hoisting devices comprise six winches 4 for sinking and positioning the immersed tube, i.e., a first winch 401, a second winch 402, a third winch 403, a fourth winch 404, a fifth winch 405 and a sixth winch 406; a first cable guiding device 101 is provided at the bow of the first ship body 1, and a hoisting cable of the first winch 401 is connected to a position on the top surface of the immersed tube 8 near the second ship body 2 along a transverse direction of the immersed tube 8 via the first cable guiding device 101; a second cable guiding device 102 is provided at the bow of the second ship body 2, and a hoisting cable of the second winch 402 is connected to a position on the top surface of the immersed tube 8 near the first ship body 1 along the transverse direction of the immersed tube 8 via the second cable guiding device 102; a third cable guiding device 103 is provided at the stern of the first ship body 1, and a hoisting cable of the third winch 403 is connected to a position on the top surface of the immersed tube 8 near the second ship body 2 along the transverse direction of the immersed tube 8 via the third cable guiding device 103; a fourth cable guiding device 104 is provided at the stern of the second ship body 2, and a hoisting cable of the fourth winch 404 is connected to a position on the top surface of the immersed tube 8 near the first ship body 1 along the transverse direction of the immersed tube 8 via the fourth cable guiding device 104; and the first to fourth winches 401-404 are used for adjusting the transverse position of the immersed tube 8; and the first connection structure 31 is provided with a fifth cable guiding device 105, and a hoisting cable of the fifth winch 405 is connected to a position at a rear end of the top surface of the immersed tube 8 along an axis of the immersed tube 8 via the fifth cable guiding device 105; the second connection structure 32 is provided with a sixth cable guiding device 106, and a hoisting cable of the sixth winch 406 is connected to a position at a front end of the top surface of the immersed tube 8 along the axis of the immersed tube 8 via the sixth cable guiding device 106; and the fifth winch 405 and the sixth winch 406 are used for adjusting the longitudinal position of the immersed tube 8.

Figure 7:
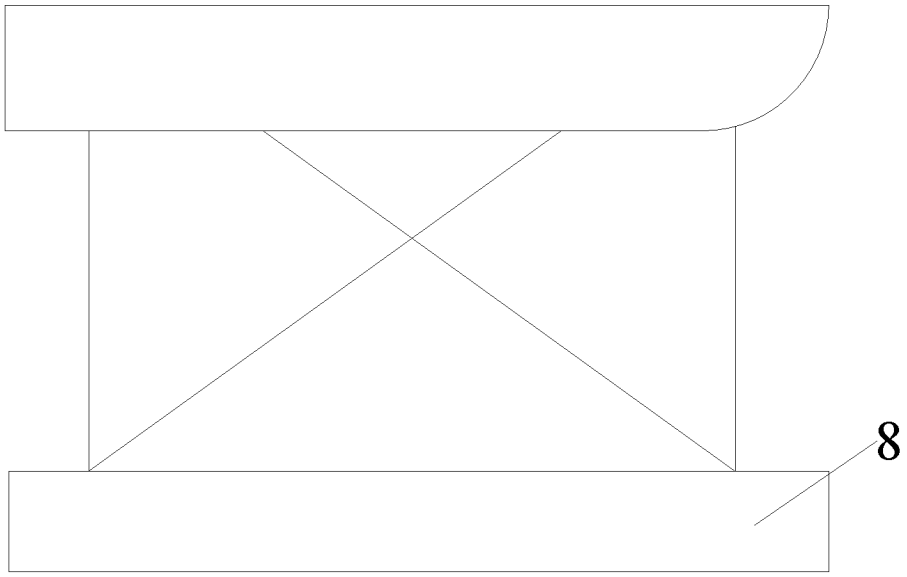
FIG. 7 is a side view of the connection between the integrated ship and the immersed tube through crossed hoisting cables according to an embodiment of the present application.

FIG. 7 is a side view showing the cross-connection mode of the hoisting cables. To more clearly show the connection mode of the hoisting cables, FIG. 7 shows a view of the immersed tube in a lifted-down state.

As a preferred implementation, the hauling and hoisting devices further comprise at least four hoisting winches used for lifting up, lifting down and adjusting the immersed tube.

Further, as shown in FIG. 6, there are four hoisting winches, i.e., a seventh winch 407, an eighth winch 408, a ninth winch 409 and a tenth winch 410; a seventh cable guiding device 107 and an eighth cable guiding device 108 are provided at positions in a front end of the integrated ship corresponding to two sides of the front end of the immersed tube 8, a hoisting cable of the seventh winch 407 is connected downward to one side of the front end of the top surface of the immersed tube 8 via the seventh cable guiding device 107, and a hoisting cable of the eighth winch 408 is connected downward to an other side of the front end of the top surface of the immersed tube 8 via the eighth cable guiding device 108; a ninth cable guiding device 109 and a tenth cable guiding device 110 are provided at positions in a rear end of the integrated ship corresponding to two sides of the rear end of the immersed tube 8, a hoisting cable of the ninth winch 409 is connected downward to one side of the rear end of the top surface of the immersed tube 8 via the ninth cable guiding device 109, and a hoisting cable of the tenth winch 410 is connected downward to an other side of the rear end of the top surface of the immersed tube 8 via the tenth cable guiding device 110.

The cable guiding devices can be fairleads or pulley blocks.

Further, preferably, a minimum length of the hoisting cable retracted or released by the first winch 401 to the tenth winch 410 at each time is in a centimeter level in order to further ensure precise positioning of the immersed tube 8.

As a preferred implementation, a length of the integrated ship is greater than or equal to 50 m in order to cooperate with the lateral propellers 62 to realize the in-situ steering of the integrated ship.

As a preferred implementation, a distance from an inner side of the first ship body to the immersed tube 8 and a distance from an inner side of the second ship body 2 to the immersed tube 8 are greater than or equal to 0.5 m, so as to prevent lateral propelling failure caused by shielding of the immersed tube 8.

Further, the positioning devices 7 are positioning anchors and windlasses, and the positioning anchors and the windlasses are arranged at the bows or the sterns of the first ship body 1 and the second ship body 2, respectively.

When the integrated ship provided by the embodiments of the present application transports an immersed tube, the sailing speed in a public navigation lane can reach 5 to 6 knots. Compared with the hauling of the immersed tube by the towing ships, the time required to occupy the navigation lane is greatly shortened, the navigation time from Guishan Island to the position of the Shenzhen-Zhongshan Channel is only 7 hours, and the time required by the transportation and installation of a single immersed tube is about 20 hours. Additionally, the integrated ship is equipped with a dynamic positioning system and has a tracks tracking function, the track width can be controlled within 85 m, and the scale of the public navigation lane can fully meet the navigation requirements. The integrated ship has the ability to resist against 2-knot transverse flow and can realize in-situ rotation within a range of 240 m in a steering area and a gyration area, and have the emergency capability for rapid return under abnormal conditions.

Another aspect of the embodiments of the present application provides a construction process of immersed tubes of an underwater tunnel, which is constructed by the integrated ship described above and specifically comprises the following steps:

outfitting, comprising:

moving the integrated ship to above a immersed tube 8 by winches, or moving a immersed tube 8 to below the integrated ship by the winches on the integrated ship;

outfitting a sinking and positioning system:

a first winch 401, a second winch 402, a third winch 403, a fourth winch 404, a fifth winch 405 and a sixth winch 406 all used for sinking and positioning the immersed tube 8 are provided on the integrated ship; a first cable guiding device 101 is provided at a bow of the first ship body 1, and connecting a hoisting cable of the first winch 401 to a position on a top surface of the immersed tube 8 near the second ship body 2 along a transverse direction of the immersed tube 8 via the first cable guiding device 101; a second cable guiding device 102 is provided at a bow of the second ship body 2, and connecting a hoisting cable of the second winch 402 to a position on the top surface of the immersed tube 8 near the first ship body 1 along the transverse direction of the immersed tube 8 via the second cable guiding device 102; a third cable guiding device 103 is provided at a stern of the first ship body 1, and connecting a hoisting cable of the third winch 403 to a position on the top surface of the immersed tube 8 near the second ship body 2 along the transverse direction of the immersed tube 8 via the third cable guiding device 103; a fourth cable guiding device 104 is provided at a stern of the second ship body 2, and connecting a hoisting cable of the fourth winch 404 to a position on the top surface of the immersed tube 8 near the first ship body 1 along the transverse direction of the immersed tube 8 via the fourth cable guiding device 104; and the first to fourth winches 401-404 are used for adjusting the transverse position of the immersed tube 8; and the first connection structure 31 is provided with a fifth cable guiding device 105, and connecting a hoisting cable of the fifth winch 405 to a position at a rear end of the top surface of the immersed tube 8 along an axis of the immersed tube 8 via the fifth cable guiding device 105; the second connection structure 32 is provided with a sixth cable guiding device 106, and connecting a hoisting cable of the sixth winch 406 to a position at a front end of the top surface of the immersed tube 8 along the axis of the immersed tube 8 via the sixth cable guiding device 106; and the fifth winch 405 and the sixth winch 406 are used for adjusting the longitudinal position of the immersed tube 8;

outfitting other members: performing hoisting operation of fitting-out parts, such as measurement towers, manholes, guide rods and guide brackets, on the top surface and inside the immersed tube by the cranes 5 on the integrated ship;

connecting the integrated ship with the immersed tube, comprising:

adding ballast water to the integrated ship to make the integrated ship move downward, and protruding members 91 on the integrated ship enter grooves 92 formed correspondingly on the top surface of the immersed tube 8;

adding ballast water continuously to make the integrated ship move downward until the protruding members 91 come into contact with the bottoms of the grooves 92 and generate a pressure that is not less than 200 tons;

utilizing limiting devices to realize firm connection of the grooves 92 and the protruding members 91;

tightening hoisting cables between the integrated ship and the immersed tube 8 by hoisting winches provided on the integrated ship and used for lifting up, lifting down and adjusting the immersed tube 8, and a single-point hoisting force is not less than 20 tons;

a plurality of pull cables 93 are provided on bottoms of the connection structures 3 close to the protruding members 91, and connecting the pull cables 93 downward to the top surface of the immersed tube 8; a pulling force of each pull cable 93 is not less than 5 tons;

measurement calibration and debugging, comprising:

measurement calibration: jointly measuring and calibrating characteristic points of the immersed tube and a guiding and positioning system by GPS, a total station instrument and other instruments arranged on a top of the measurement tower to ensure normal operation of a measurement and control system installed on the immersed tube 8;

debugging: simulating a sinking process of the immersed tube and jointly debugging the measurement and control system, a water ballast system, a winch system, a communication and illumination system, an in-tube monitoring system, a CCTV monitoring system and the like in preparation for the floating transportation of the immersed tube 8;

floating transportation of the immersed tube: using the main propellers 61 and the lateral propellers 62 to drive the integrated ship for self-propulsion, and the integrated ship drives the immersed tube 8 to move and steer along with the integrated ship by interaction force between the protruding members 91 and the bottom of the grooves 92; resisting external loads received by the integrated ship and the immersed tube during the floating transportation by means of power generated by the main propellers 61 and the lateral propellers 62; utilizing a dynamic positioning system provided on the integrated ship to ensure that the integrated ship and the immersed tube are navigated along the planned route and positioned to a site where the immersed tube is to be installed; specifically, the floating transportation comprises the following steps:

before the floating transportation, setting a navigation route for transporting the immersed tube by the integrated ship according to the site where the immersed tube 8 is to be installed, preparing a navigation plan, and determining the total mileage and the estimated navigation time of the navigation route, the longitude and latitude of each steering point, the navigation method for a complex leg and the measures for avoiding hazards near the navigation route, and detecting the main navigation devices to ensure the devices are in a good state;

listening and analyzing relevant meteorological information in time; adjusting the sailing speed in time when encountering heavy wind and waves to ensure the transportation stability of the immersed tube 8 and the safety of the integrated ship; the power of the main propellers should be adjusted slowly to prevent the speed from increasing or decreasing too fast;

utilizing a plurality of navigation systems (two sets of GPS ad Beidou) to check the position of the ship in real time, so it is ensured that the integrated ship does not deviate from the navigation route; notifying the captain in time if yaw or abnormal conditions are found, and adjusting the propelling power devices 6 in time to correct the deviation of the ship and make the ship return back to the navigation route;

using the main propellers 61 and the lateral propellers 62 to drive the integrated ship for self-propulsion, and the integrated ship drives the immersed tube 8 to move along with the integrated ship by the interaction force between the protruding members 91 and the immersed tube 8, so as to realize the floating transportation of the immersed tube 8; the protruding members 91 and the grooves 92 ensures that no relative movement is generated between the integrated ship and the immersed tube 8, so that the stability and safety during the floating transportation of the immersed tube 8 are realized;

when the integrated ship sails to the site where the immersed tube 8 is to be installed, the integrated ship inevitably travels in a direction perpendicular to the transverse flow direction, the ship performs in-situ steering by the DP system 20, and the lateral propellers 62 are activated, ensuring the stability of the integrated ship and reducing the transverse inclination and transverse displacement;

during the whole navigation, patrolling and inspecting the connection points between the immersed tube 8 and the integrated ship to prevent the relative movement between the immersed tube 8 and the integrated ship; recording the navigation operation and the immersed tube inspection;

installing the immersed tube 8, comprising:

positioning and mooring the integrated ship by the dynamic positioning system;

removing the pull cables 93 and the limiting devices, discharging the ballast water from the integrated ship to release the pressure between the protruding members 91 and the immersed tube 8, and maintaining the stability of the designed cable force;

the immersed tube 8 begins to be lifted down by the hoisting cables, and controlling the first winch 401 to the sixth winch 406 to rectify the transverse and longitudinal positions of the immersed tube 8 and adjust gradient of the immersed tube 8, so that the installation of the immersed tube 8 is further completed.

After the above construction process has been completed, removing the fitting-out parts such as the measurement towers, the manholes and the pull-in jack on the immersed tube 8 by the cranes on the integrated ship, and then the integrated ship makes a return voyage in preparation for the floating transportation and installation of a next immersed tube.

The sequential order of the steps in the above construction process is not strictly required, and may be adjusted by those skilled in the art according to actual operation requirements.

The present application is described in detail above, but what is mentioned above is merely better embodiments of the present application and cannot be considered as limitation to the implementation scope of the present application. All equal changes and improvements made in accordance with the scope of the present application shall remain within the scope of the present application.

The invention claimed is:

1. A self-propelled integrated ship for transporting and installing immersed tubes of underwater tunnel, comprising a first ship body, a second ship body, a connection structure, hauling and hoisting devices, propelling power devices and positioning devices;

wherein the first ship body and the second ship body are parallel with each other, the connection structure is arranged between the first ship body and the second ship body, the first ship body, the second ship body and the connection structure are provided with the hauling and hoisting devices;

a loading space is formed between the first ship body and the second p body and below the connection structure, the loading space is opened downward, and a to-be-installed member is arranged in the loading space and is connected with the ship; and the first ship body and the second ship body are provided with the propelling power devices and the positioning devices;

wherein the to-be-installed member is an immersed tube which is floated in water during transportation; protruding members are arranged on a bottom of the connection structure, and a number of the protruding members is greater than or equal to 2; when the integrated ship is in a water ballasting state, a pressure contact is formed between bottom surfaces of the protruding members and the immersed tube subjected to buoyancy so as to transmit a propelling power of the integrated ship to the immersed tube and drive the immersed tube to sail together.

2. The integrated ship according to claim 1, wherein a spacer is provided on the bottom surface of each of the protruding members, and a friction coefficient between the spacer and the immersed tube is greater than or equal to 0.5.

3. The integrated ship according to claim 1, wherein the protruding members are inserted into grooves formed correspondingly on a top surface of the immersed tube to limit movement of the immersed tube relative to the integrated ship.

4. The integrated ship according to claim 3, wherein a limiting device is arranged between the groove and the protruding member to realize firm connection of the groove and the protruding member.

5. The integrated ship according to claim 1, wherein a plurality of pull cables connected to the immersed tube are provided on the bottom of the connection structure close to the protruding members.

6. The integrated ship according to claim 1, wherein the propelling power devices comprise a main propeller respectively arranged at a stern of the first ship body and a stern of the second ship body, and lateral propellers respectively arranged at a bow and the stern of the first ship body and a bow and the stern of the second ship body; and a dynamic positioning system is further provided on the integrated ship to control powers of the propelling power devices so as to successfully realize tracks tracking function and a dynamic positioning function.

7. The integrated ship according to claim 6, wherein at least two lateral propellers are respectively arranged at the bow and the stern of the first ship body, and at least two lateral propellers are respectively arranged at the bow and the stern of the second ship body.

8. The integrated ship according to claim 6, wherein a distance from an inner side of the first ship body to the immersed tube and a distance from an inner side of the second ship body to the immersed tube are greater than or equal to 0.5 m, so as to prevent lateral propelling failure caused by shielding of the immersed tube.

9. The integrated ship according to claim 1, wherein a number of the connection structures is greater than or equal to 2, and the transportation and installation of immersed tubes of different sizes is realized by combination of at least two connection structures; a connection structure above a front end of the immersed tube is a first connection structure, and a connection structure above a rear end of the immersed tube is a second connection structure.

10. The integrated ship according to claim 9, wherein hoisting cables used for adjusting transverse and longitudinal positions of the immersed tube are arranged in a crossed manner between the integrated ship and the immersed tube.

11. The integrated ship according to claim 10, wherein the hauling and hoisting devices comprise six winches, that is, a first winch, a second winch, a third winch, a fourth winch, a fifth winch and a sixth winch; a first cable guiding device is provided at the bow of the first ship body, and a hoisting cable of the first winch is connected to a position on the top surface of the immersed tube near the second ship body along a transverse direction of the immersed tube via the first cable guiding device; a second cable guiding device is provided at the bow of the second ship body, and a hoisting cable of the second winch is connected to a position on the top surface of the immersed tube near the first ship body along the transverse direction of the immersed tube via the second cable guiding device; a third cable guiding device is provided at the stern of the first ship body, and a hoisting cable of the third winch is connected to a position on the top surface of the immersed tube near the second ship body along the transverse direction of the immersed tube via the third cable guiding device; a fourth cable guiding device is provided at the stern of the second ship body, and a hoisting cable of the fourth winch is connected to a position on the top surface of the immersed tube near the first ship body along the transverse direction of the immersed tube via the fourth cable guiding device; and the first to fourth winches are used for adjusting the transverse position of the immersed tube;

the first connection structure is provided with a fifth cable guiding device, and a hoisting cable of the fifth winch is connected to a position at a rear end of the top surface of the immersed tube along an axis of the immersed tube via the fifth cable guiding device; the second connection structure is provided with a sixth cable guiding device, and a hoisting cable of the sixth winch is connected to a position at a front end of the top surface of the immersed tube along the axis of the immersed tube via the sixth cable guiding device; and the fifth winch and the sixth winch are used for adjusting the longitudinal position of the immersed tube.

12. The integrated ship according to claim 11, wherein the hauling and hoisting devices further comprise at least four hoisting winches used for lifting up, lifting down and adjusting the immersed tube.

13. The integrated ship according to claim 12, wherein there are four hoisting winches, that is, a seventh winch, an eighth winch, a ninth winch and a tenth winch; a seventh cable guiding device and an eighth cable guiding device are provided at positions in a front end of the integrated ship corresponding to two sides of the front end of the immersed tube, a hoisting cable of the seventh winch is connected downward to one side of the front end of the top surface of the immersed tube via the seventh cable guiding device, and a hoisting cable of the eighth winch is connected downward to an other side of the front end of the top surface of the immersed tube via the eighth cable guiding device; a ninth cable guiding device and a tenth cable guiding device are provided at positions in a rear end of the integrated ship corresponding to two sides of the rear end of the immersed tube, a hoisting cable of the ninth winch is connected downward to one side of the rear end of the top surface of the immersed tube via the ninth cable guiding device, and a hoisting cable of the tenth winch is connected downward to an other side of the rear end of the top surface of the immersed tube via the tenth cable guiding device.

14. The integrated ship according to claim 13, wherein a minimum length of the hoisting cable retracted or released by the first winch to the tenth winch at each time is in a centimeter level.

15. The integrated ship according to claim 1, wherein a length of the integrated ship is greater than or equal to 50 m in order to cooperate with the lateral propellers to realize in-situ steering of the integrated ship.

16. A construction process of transporting and installing immersed tubes of an underwater tunnel, which is realized by an integrated ship, wherein the integrated ship comprises a first ship body, a second ship body, connection structures, hauling and hoisting devices, propelling power devices and positioning devices; the first ship body and the second ship body are parallel with each other, the connection structures are arranged between the first ship body and the second ship body, the first ship body, the second ship body and the connection structures are provided with winches; a loading space is formed between the first ship body and the second ship body and below the connection structures; a main propeller is respectively arranged at a stern of the first ship body and a stern of the second ship body, and lateral propellers are respectively arranged at a bow and the stern of the first ship body and a bow and the stern of the second ship body; a plurality of protruding members are arranged on bottoms of the connection structures;

the construction process comprises the following steps:

outfitting, comprising:

moving the integrated ship to above a immersed tube by winches, or moving a immersed tube to below the integrated ship by the winches on the integrated ship;

outfitting a sinking and positioning system:

a first winch, a second winch, a third winch, a fourth winch, a fifth winch and a sixth winch all used for sinking and positioning the immersed tube are provided on the integrated ship; a first cable guiding device is provided at the bow of the first ship body, and connecting a hoisting cable of the first winch to a position on a top surface of the immersed tube near the second ship body along a transverse direction of the immersed tube via the first cable guiding device; a second cable guiding device is provided at the bow of the second ship body, and connecting a hoisting cable of the second winch to a position on the top surface of the immersed tube near the first ship body along the transverse direction of the immersed tube via the second cable guiding device; a third cable guiding device is provided at the stern of the first ship body, and connecting a hoisting cable of the third winch to a position on the top surface of the immersed tube near the second ship body along the transverse direction of the immersed tube via the third cable guiding device; a fourth cable guiding device is provided at the stern of the second ship body, and connecting a hoisting cable of the fourth winch to a position on the top surface of the immersed tube near the first ship body along the transverse direction of the immersed tube via the fourth cable guiding device; and the first to fourth winches are used for adjusting the transverse position of the immersed tube; and a connection structure above a front end of the immersed tube is a first connection structure, and a connection structure above a rear end of the immersed tube is a second connection structure; the first connection structure is provided with a fifth cable guiding device, and connecting a hoisting cable of the fifth winch to a position at a rear end of the top surface of the immersed tube along an axis of the immersed tube via the fifth cable guiding device; the second connection structure is provided with a sixth cable guiding device, and connecting a hoisting cable of the sixth winch to a position at a front end of the top surface of the immersed tube along the axis of the immersed tube via the sixth cable guiding device; and the fifth winch and the sixth winch are used for adjusting the longitudinal position of the immersed tube;

connecting the integrated ship with the immersed tube, comprising:

adding ballast water to the integrated ship to make the integrated ship move downward, and protruding members on the integrated ship contacts the top surface of the immersed tube; adding ballast water continuously to generate a pressure between the integrated ship and the immersed tube and the pressure is not less than 200 tons;

tightening hoisting cables between the integrated ship and the immersed tube by hoisting winches provided on the integrated ship and used for lifting up, lifting down and adjusting the immersed tube;

floating transportation of the immersed tube: using the main propellers and the lateral propellers to drive the integrated ship for self-propulsion, and the integrated ship drives the immersed tube to move and steer along with the integrated ship by interaction force generated by the connection between the integrated ship and the immersed tube; resisting external loads received by the integrated ship and the immersed tube during the floating transportation by means of power generated by the main propellers and the lateral propellers; utilizing a dynamic positioning system provided on the integrated ship to ensure that the integrated ship and the immersed tube are navigated along a planned route and positioned to a site where the immersed tube is to be installed;

installing the immersed tube, comprising:

positioning and mooring the integrated ship by the dynamic positioning system;

discharging the ballast water from the integrated ship to release the pressure between the protruding members and the immersed tube;

the immersed tube begins to be lifted down by the hoisting cables, and controlling the first winch to the sixth winch to rectify the transverse and longitudinal positions of the immersed tube and adjust gradient of the immersed tube, so that the installation of the immersed tube is further completed.

17. The construction process of transporting and installing immersed tubes of an underwater tunnel, wherein, comprising the following steps:

outfitting, comprising:

moving the integrated ship to above the immersed tube by winches, or moving the immersed tube to below the integrated ship by the winches on the integrated ship;

outfitting the sinking and positioning system:

the first winch, the second winch, the third winch, the fourth winch, the fifth winch and the sixth winch all used for sinking and positioning the immersed tube are provided on the integrated ship; the first cable guiding device is provided at the bow of the first ship body, and connecting the hoisting cable of the first winch to the position on the top surface of the immersed tube near the second ship body along the transverse direction of the immersed tube via the first cable guiding device; the second cable guiding device is provided at the bow of the second ship body, and connecting the hoisting cable of the second winch to the position on the top surface of the immersed tube near the first ship body along the transverse direction of the immersed tube via the second cable guiding device; the third cable guiding device is provided at the stern of the first ship body, and connecting the hoisting cable of the third winch to the position on the top surface of the immersed tube near the second ship body along the transverse direction of the immersed tube via the third cable guiding device; the fourth cable guiding device is provided at the stern of the second ship body, and connecting the hoisting cable of the fourth winch to the position on the top surface of the immersed tube near the first ship body along the transverse direction of the immersed tube via the fourth cable guiding device; and the first to fourth winches are used for adjusting the transverse position of the immersed tube; and the connection structure above the front end of the immersed tube is the first connection structure, and the connection structure above the rear end of the immersed tube is the second connection structure; the first connection structure is provided with the fifth cable guiding device, and connecting the hoisting cable of the fifth winch to the position at the rear end of the top surface of the immersed tube along an axis of the immersed tube via the fifth cable guiding device; the second connection structure is provided with the sixth cable guiding device, and connecting the hoisting cable of the sixth winch to the position at the front end of the top surface of the immersed tube along the axis of the immersed tube via the sixth cable guiding device; and the fifth winch and the sixth winch are used for adjusting the longitudinal position of the immersed tube;

connecting the integrated ship with the immersed tube, comprising:

adding ballast water to the integrated ship to make the integrated ship move downward, and protruding members on the integrated ship enter grooves formed correspondingly on the top surface of the immersed tube;

adding ballast water continuously to make the integrated ship move downward until the protruding members come into contact with bottoms of the grooves and generate a pressure that is not less than 200 tons;

using limiting devices to realize firm connection of the grooves and the protruding members;

tightening hoisting cables between the integrated ship and the immersed tube by hoisting winches provided on the integrated ship and used for lifting up, lifting down and adjusting the immersed tube;

a plurality of pull cables are provided on bottoms of the connection structures close to the protruding members, and connecting the pull cables downward to the top surface of the immersed tube;

floating transportation of the immersed tube: using the main propellers and the lateral propellers to drive the integrated ship for self-propulsion, and the integrated ship drives the immersed tube to move and steer along with the integrated ship by interaction force between the protruding members and the bottom of the grooves; resisting external loads received by the integrated ship and the immersed tube during the floating transportation by means of power generated by the main propellers and the lateral propellers; utilizing the dynamic positioning system provided on the integrated ship to ensure that the integrated ship and the immersed tube are navigated along the planned route and positioned to a site where the immersed tube is to be installed;

installing the immersed tube, comprising:

positioning and mooring the integrated ship by the dynamic positioning system;

removing the pull cables and the limiting devices, discharging the ballast water from the integrated ship to release the pressure between the protruding members and the immersed tube;

the immersed tube begins to be lifted down by the hoisting cables, and controlling the first winch to the sixth winch to rectify the transverse and longitudinal positions of the immersed tube and adjust gradient of the immersed tube, so that the installation of the immersed tube is further completed.

18. A self-propelled integrated ship for transporting and installing immersed tubes of underwater tunnel, comprising a first ship body, a second ship body, a connection structure, hauling and hoisting devices, propelling power devices and positioning devices;

wherein the first ship body and the second ship body are parallel with each other, the connection structure is arranged between the first ship body and the second ship body, the first ship body, the second ship body and the connection structure are provided with the hauling and hoisting devices;

a loading space is formed between the first ship body and the second ship body and below the connection structure, a to-be-installed member is entirely arranged in the loading space and is connected with the ship; and, the first ship body and the second ship body are provided with the propelling power devices and the positioning devices;

wherein the loading space is opened downward, and the to-be-installed member is an immersed tube which is floated in water during transportation; a protruding member is arranged on a bottom of the connection structure; when the integrated ship is in a water ballasting state, a pressure contact is formed between bottom surface of the protruding member and the immersed tube subjected to buoyancy so as to transmit a propelling power of the integrated ship to the immersed tube and drive the immersed tube to sail together.

* * * * *